US006244880B1

(12) United States Patent
Fukase et al.

(10) Patent No.: US 6,244,880 B1
(45) Date of Patent: Jun. 12, 2001

(54) LOW-INSERTION FORCE CONNECTOR

(75) Inventors: Yoshihiro Fukase; Toru Nagano, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/632,635

(22) Filed: Aug. 4, 2000

(30) Foreign Application Priority Data

Aug. 4, 1999 (JP) ..... 11-220778

(51) Int. Cl.[7] ..... H01R 13/62
(52) U.S. Cl. ..... 439/157; 439/347
(58) Field of Search ..... 439/157, 347, 439/310

(56) References Cited

U.S. PATENT DOCUMENTS

| | | | |
|---|---|---|---|
| 4,586,771 | 5/1986 | Kraemer et al. | 339/75 MP |
| 5,326,274 | 7/1994 | Pfaff et al. | 439/157 |
| 5,672,067 | 9/1997 | Ryll et al. | 439/157 |
| 5,902,141 | 5/1999 | Iwahori | 439/157 |

FOREIGN PATENT DOCUMENTS

| | | | |
|---|---|---|---|
| 61-203581 | 9/1986 | (JP) | H01R/13/629 |
| 6-2577 | 1/1994 | (JP) | H01R/13/629 |
| 6-60934 | 3/1994 | (JP) | H01R/13/629 |
| 6-215827 | 8/1994 | (JP) | H01R/13/629 |
| 8-335477 | 12/1996 | (JP) | H01R/13/629 |
| 9-266029 | 10/1997 | (JP) | H01R/23/00 |

OTHER PUBLICATIONS

Abstract JP 61203581A Sep. 09, 1986.
Abstract JP 9266029A Oct. 07, 1997.
Abstract JP 6060934A Mar. 04, 1994.
Abstract JP 8335477A Dec. 17, 1996.
Abstract JP 6215827A.

*Primary Examiner*—Gary F. Paumen
*Assistant Examiner*—Ross Gushi
(74) *Attorney, Agent, or Firm*—Sughrue, Mion, Zinn, Macpeak & Seas, PLLC

(57) ABSTRACT

A provisionally-retaining arm (7), which has a retaining projection (8), and extends in a connector fitting direction, is formed on a connector housing (2). A vertical one side surface (8*b*) of the retaining projection is abutted against a vertical one side surface (17*a*) of an inlet portion (17) of a guide hole (9), thereby provisionally retaining a slider (4) in a completely-locked condition. When the two connector housings (2, 5) are to be fitted together, the retaining projection (8) is disposed in opposed relation to a follower projection (10). A landing portion (16) and a relief portion (11) for the retaining projection (8) are provided adjacent to the inlet portion (17). At least one of the other side surface of the retaining projection and an end edge portion of the relief portion (11) is formed in a slanting condition. An auxiliary retaining arm is formed on the slider (4), and a provisionally-retaining hole and a completely-retaining hole are formed in the connector housing (2). A vertical retaining surface and a slanting surface, which are directed in a slider releasing direction, are formed on the retaining projection of the auxiliary retaining arm, and a vertical abutment surface is formed on an inner surface of the provisionally-retaining hole.

13 Claims, 10 Drawing Sheets

2
43
41
29
42
17
9
6
4
19
13
36b
42b
36
42c
42
42a
36a
29
39
36c

LOW-INSERTION FORCE CONNECTOR

BACKGROUND OF THE INVENTION

1. Field of the Invention

The present invention relates to a low-insertion force connector in which a force to provisionally retain a slider, provided for fitting male and female connectors together with a low operating force, is increased so as to prevent the slider from being accidentally pushed into a connector housing.

The present application is based on Japanese Patent Application No. Hei. 11-220778, which is incorporated herein by reference.

2. Description of the Related Art

FIG. 12 shows a conventional low-insertion force connector disclosed in Unexamined Japanese Patent Publication No. Hei. 61-203581.

This low-insertion force connector 51 comprises a male connector housing 52, a female connector housing 53, and a slider 54, these parts being made of a synthetic resin. Follower projections 55 are formed on the male connector housing 52, and guide grooves 56 for respectively guiding the follower projections 55 are formed in the female connector housing 53, and extend in a connector fitting direction. Slanting guide holes 57 for respectively receiving the follower projections 55 are formed in the slider 54. When the slider 54 is pushed or inserted into the female connector housing, the follower projections 55 are guided or moved in the connector fitting direction along the respective guide holes 57 and also along the respective guide grooves 56, so that the two connector housings 52 and 53 are fitted together.

Actually, female terminals (not shown), each connected to a wire, are received in the male connector housing 52, and male terminals (not shown), each connected to a wire, are received in the female connector housing 53, and tab-like contact portions of the male terminals (not shown) project into a connector fitting chamber 58 in the female connector housing 53. The male connector housing 52 and the associated terminals jointly form a male connector while the female connector housing 53 and the associated terminals jointly form a female connector. A large force is required for fitting many male and female terminals together, and therefore the guide holes 57 have a length larger than the connector-fitting distance, and with this construction the low insertion force design of the connector is achieved.

The slider 54 is inserted into the connector fitting chamber 58. A provisionally-retaining arm 59 and a completely-retaining arm 60 for the slider 54 are provided on the female connector housing 53, and extend in a slider inserting direction. The provisionally-retaining arm 59 has an abutment projection for engagement with a step portion 61 of the slider 54, and the completely-retaining arm 60 has an engagement recess for engagement with a projection 62 of the slider 54.

The slider 54 is initially inserted into the connector fitting chamber 58 while flexing (elastically deforming) the provisionally-retaining arm 59, and the projection of the provisionally-retaining arm 59 is engaged with the step portion 61 of the slider 54, thereby preventing the rearward withdrawal of the slider 54. In this condition, the male connector housing 52 is initially fitted into the connector fitting chamber 58. In this condition, the male terminals (not shown) are not yet fitted in the female terminals (not shown), respectively. When the slider 54 is further inserted, the follower projections 55 are moved in the connector fitting direction along the respective guide holes 57 as described above, and the two connector housings 52 and 53 are fitted together, so that the male terminals are connected to the female terminals, respectively. When the slider 54 is completely inserted into the female connector housing, the projection 62 is engaged with the completely-retaining arm 60, thereby preventing the rearward withdrawal of the slider 54.

In the above conventional construction, for example, the slider 54 is attached in an initially-inserted condition to the female connector housing 53 while the male connector housing 52 is not connected to the female connector housing 53, and during the transport of the connector in this condition (for example, in the form of a wire harness assembly), the slider 54 can be easily pushed or inserted into the completely-retained condition upon slight interference with an external object. As a result, when the male connector housing 52 is to be fitted into the female connector housing 53 in a vehicle-assembling process, the slider 54 must be returned to the initially-inserted condition, and therefore extra time and labor are required, thus lowering the efficiency of the operation. And besides, if the operator is not sufficiently skilled, there is a possibility that the completely-retained condition of the slider can not be canceled, or the slider may not be sufficiently returned, and as a result the two connectors can not be properly fitted together.

FIGS. 13A, 13B, 14A and 14B show another conventional low-insertion force connector disclosed in Unexamined Japanese Patent Publication No. Hei. 6-215827.

This low-insertion force connector 65 comprises a male connector housing 66, a female connector housing 67, and a slider 68. The male connector housing 66 has follower projections 69, and the slider 68 has slanting guide holes 70 for respectively receiving the follower projections 69, and also has retaining arms 71 which extend in a connector fitting direction so as to retain the male connector housing 66. Engagement holes 73 for engagement respectively with retaining projections 72 of the retaining arms 71 are formed in the male connector housing 66. Provisionally-retaining recesses 75 for engagement respectively with the distal ends of the retaining arms 71 are formed respectively in flanges 74 formed at a peripheral edge portion of an opening in the female connector housing 67.

In a condition shown in FIG. 13, the distal ends of the retaining arms 71 are engaged respectively in the recesses 75, thereby provisionally retaining the slider 68 relative to the female connector housing 67. When the male connector housing 66 is initially fitted into the female connector housing 67, the follower projections 69 are engaged respectively in inlet portions of the guide holes 70, and also the engagement projections 72 of the retaining arms 71 are pressed by the male connector housing 66, and therefore the retaining arms 71 are flexed outwardly, so that the provisionally-retained condition is canceled.

In this condition, when the slider is pushed into the female connector housing as indicated by arrow A (FIG. 14B), the follower projections 69 are moved in the connector fitting direction along the respective guide holes 70, so that the two connectors (each having associated terminals (not shown) each connected to a wire) are completely fitted together. Simultaneously when the two connectors are thus completely fitted together, the projections 72 of the retaining arms 71 are engaged in the engagement holes 73, respectively, so that the male connector housing 66 is locked against withdrawal, and also the slider 68 is completely retained.

In the above conventional construction, however, although there is provided the means for provisionally retaining the slider 68, the provisionally-retained condition is achieved by the engagement of the distal end of each retaining arm 71 in the recess 75 in the flange 74 of the female connector housing 67, and therefore the provisionally-retaining force is small. Therefore, there has been a possibility that the slider 68 is accidentally pushed into and withdrawn from the female connector housing upon interference with an external object during the transport of the connector as described above for the first-mentioned conventional construction.

SUMMARY OF THE INVENTION

With the above problems in view, it is an object of the present invention to provide a low-insertion force connector in which a force to retain a slider is increased so as to positively prevent the slider from being easily pushed into and withdrawn from a connector housing upon interference with an external object during the transport of the connector.

To achieve the above object, according to the first aspect of the present invention, there is provided a low-insertion force connector which comprises a first connector housing, a second connector housing fittable to the first connector housing, a slider insertable into the first connector housing in a direction perpendicular to a connector fitting direction, the slider having at least one slanting guide hole having an inlet portion, a follower projection insertable in the inlet portion of the guide hole, the follower projection being formed on the second connector housing, and a provisionally-retaining arm formed on the first connector housing to extend in the connector fitting direction, the provisionally-retaining arm having a retaining projection, the retaining projection having a vertical side surface which abuts against a vertical side surface of the inlet portion of the guide hole so as to provisionally retain the slider.

According to the second aspect of the present invention, it is preferable that when the first and second connector housings are about to be fitted together, the retaining projection is located in opposed relation to the follower projection.

According to the third aspect of the present invention, it is preferable that the low-insertion force connector further comprises a landing portion and a relief portion for the retaining projection provided at the slider in adjacent relation to the inlet portion, and arranged in a slider releasing direction in an order mentioned above.

According to the fourth aspect of the present invention, it is preferable that at least one of the other side surface of the retaining projection relative to the vertical side surface and an end edge portion of the relief portion is formed in a slanting manner, wherein when the retaining projection is received in the relief portion, the other side surface of the retaining projection contacts the end edge portion of the relief portion.

According to the fifth aspect of the present invention, it is preferable that the low-insertion force connector further comprises an auxiliary retaining arm having a retaining projection, the auxiliary retaining arm being formed on the slider, and wherein a provisionally-retaining hole and a completely-retaining hole for the retaining projection of the auxiliary retaining arm, are formed in the first connector housing.

According to the sixth aspect of the present invention, it is preferable that a vertical retaining surface and a slanting surface, which are directed in the slider releasing direction, are formed on the retaining projection of the auxiliary retaining arm, and a vertical abutment surface contacting the retaining surface is formed on an inner surface of the provisionally-retaining hole.

According to the seventh aspect of the present invention, it is preferable that the vertical side surface of the retaining projection and the vertical side surface of the inlet portion of the guide hole extend in a direction substantially perpendicular to a slider inserting direction into the first connector housing.

DETAILED DESCRIPTION OF THE PREFERRED EMBODIMENTS

FIGS. 1 to 5 show one preferred embodiment of a low-insertion force connector of the present invention.

Figure 1:
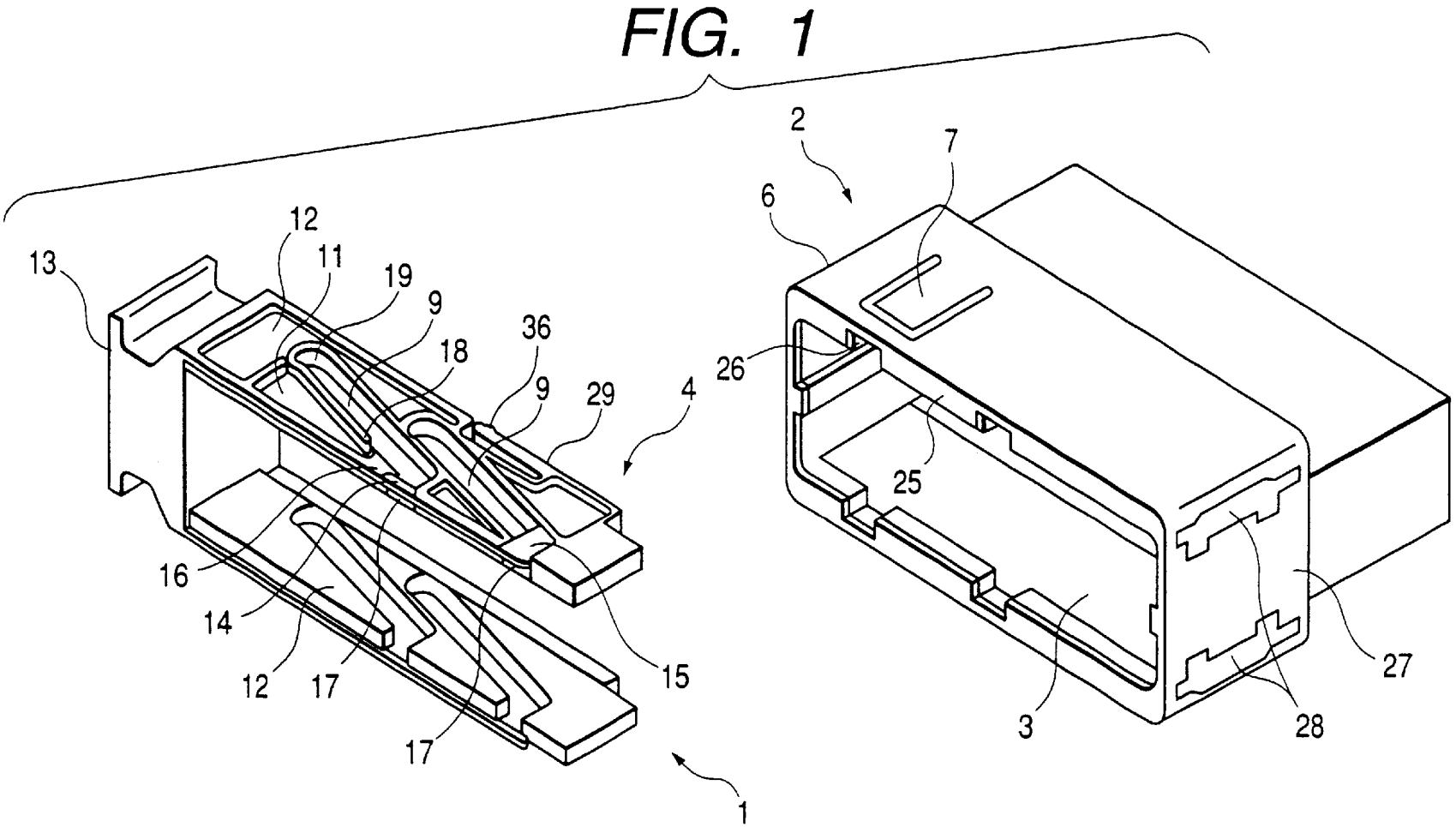
FIG. 1 is an exploded, perspective view of one preferred embodiment of a low-insertion force connector of the present invention.
Figure 2:
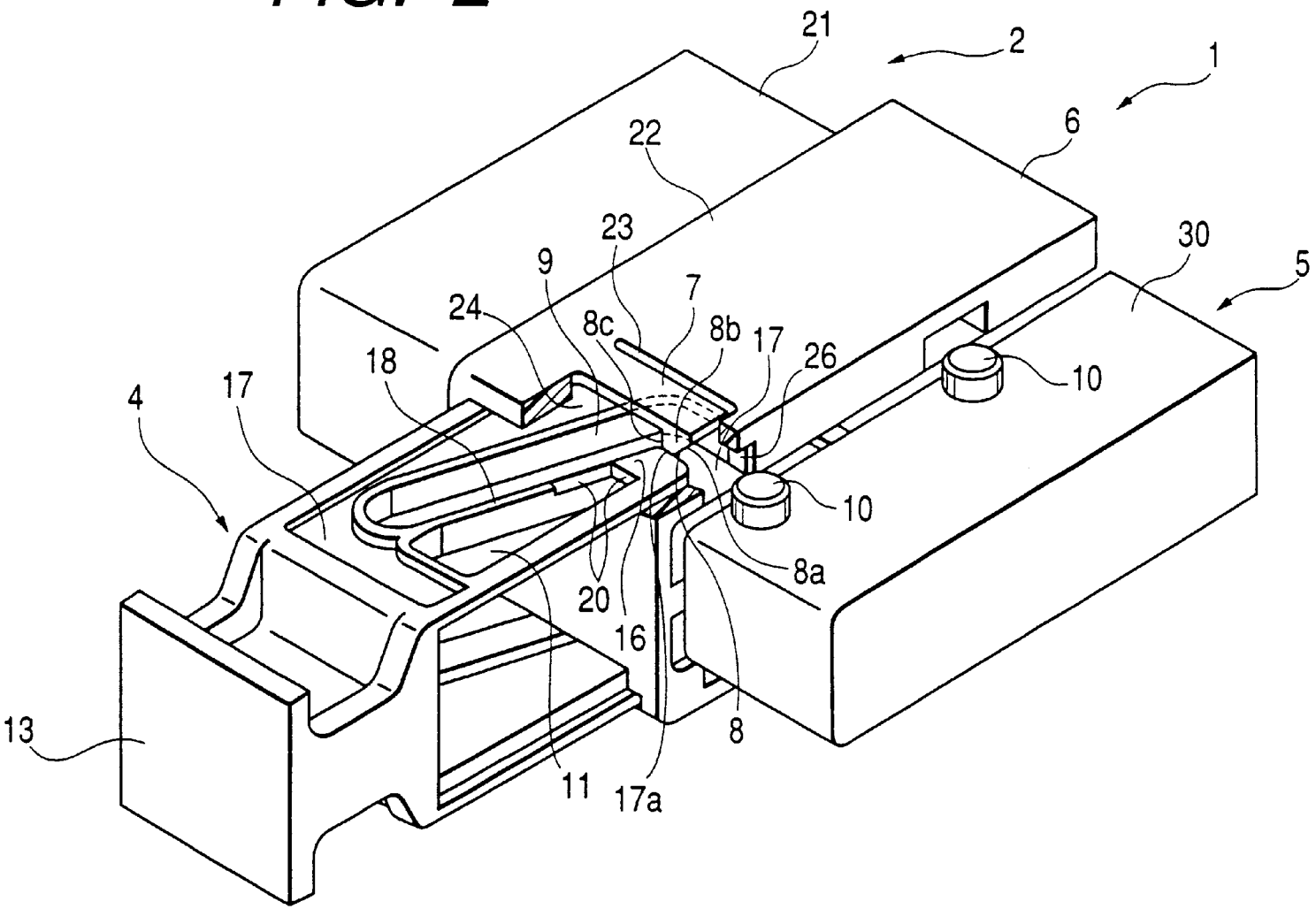
FIG. 2 is a perspective view of the low-insertion force connector, showing a provisionally-retained condition of a slider.

As shown in FIGS. 1 and 2, this low-insertion force connector 1 comprises a female connector housing 2, made of a synthetic resin, a slider 4 of a synthetic resin for insertion into a connector fitting chamber 3 in the female connector housing 2 in a direction perpendicular to a connector fitting direction, and a male connector housing 5 (FIG. 2) of a synthetic resin for fitting into the connector fitting chamber 3. A provisionally-retaining arm 7 is formed on a hood portion 6 of the female connector housing 2, forming the connector fitting chamber 3, and extends in the connector fitting direction. A retaining projection 8 (FIG. 2), formed at a distal end of the provisionally-retaining arm 7, is engaged in an inlet portion 17 of a slanting (cam-like) guide hole 9 in the slider 4, and the provisionally-retaining arm 7 can be elastically deformed outwardly (upwardly) by a follower projection 10 on the male connector housing 5. The slider 4 has a relief hole (relief portion) 11 for receiving the retaining projection 8.

As shown in FIG. 1, the slider 4 includes a pair of upper and lower rectangular base plate portions 12, and an operating portion 13 interconnecting the two base plate portions 12 at proximal ends thereof. A pair of guide holes 9 are formed in each of the base plate portions 12, and the relief hole 11 for receiving the retaining projection 8 (FIG. 2) of the provisionally-retaining arm 7 is formed in the upper base plate portion 12, and is disposed adjacent to the rear guide hole 9 in a slider-inserting direction.

The guide holes 9 are formed through the base plate portion 12 in a direction of a thickness thereof. Each guide hole 9 includes the short inlet portion 17 extending in the connector fitting direction, a long slanting portion 18 extending from the inlet portion 17 in a slanting manner in a direction opposite to the slider-inserting direction, and a short, horizontal lock portion 19 extending from an inner end of the slanting portion 18. The inlet portion 17 is open to one side edge of the base plate portion 12, and a narrow interconnecting portion 14 and a wide interconnecting portion 15 are formed at outer sides of the two inlet portions 17, respectively, so as to prevent the spreading of the guide holes 9.

The width of the inlet portion 17 is slightly larger than the width of the retaining projection 8 (FIG. 2), and the retaining projection 8 can be fitted into the inlet portion 17. When the retaining projection 8 is engaged in the inlet portion 17, the slider 4 is provisionally retained relative to the female connector housing 2. The provisionally-retained condition of the slider 4 is achieved by the abutting engagement (in a completely-locked condition) of vertical surfaces (described later) with each other. The inlet portion 17 of the front guide hole 9 (in the inserting direction) in the slider 4 is covered by the cover-like, wide interconnecting portion 15 so that the retaining projection 8 (FIG. 2) will not fit into this inlet portion 17 during the insertion of the slider 4.

The relief hole 11 of a generally triangular shape has one end disposed adjacent to the inlet portion 17, and extends along the slanting portion 18 of the cam groove (guide hole) 9, the relief hole 11 being formed through the base plate portion 12 in the direction of the thickness thereof. A flat landing portion 16 is disposed horizontally between the relief hole 11 and the inlet portion 17, and this landing portion 16 is generally equal in width to the retaining projection 8 (FIG. 2). The size of the relief hole 11 is larger than the dimension of the retaining projection 8 from the front side thereof to the rear side thereof, so that the relief hole 11 can fully receive the retaining projection 8 therein.

As shown in FIG. 2, the retaining projection 8 has a generally triangular cross-section, and has a first slanting surface 8*a*, defining a slanting front surface thereof, a retaining surface 8*b*, defining one side surface thereof to be directed toward the landing portion 16, a vertical surface 8*c*, defining a rear surface thereof, and a second slanting surface (not shown) defining the other side surface thereof. The retaining surface 8*b* is disposed vertically in the direction of the thickness of the provisionally-retaining arm 7. One side surface 17*a* of the inlet portion 17 of the guide hole 9, corresponding to the retaining surface 8*b*, is disposed vertically in the direction of the thickness of the base plate portion 12. When the slider 4 is accidentally pushed or inserted, the retaining surface (vertical surface) 8*b* of the retaining projection 8 abuts against the one side surface (vertical surface) 17*a* of the inlet portion 17, defining the front end surface of the landing portion 16, thereby increasing the force to retain the slider 4 in the pushing direction, so that the completely-locked condition can be achieved.

Slanting guide surfaces 20 are formed respectively at upper portions of the front end portions of the relief hole 11 and the slanting portion 18. When the slider 4 is drawn, the second slanting surface (not shown) of the retaining projection 8, defining the other side surface thereof, is smoothly brought into sliding contact with the slanting guide surfaces 20, and therefore the operation for drawing the slider 4, that is, the connector-disconnecting operation, can be effected smoothly. And besides, the retaining projection 8 can smoothly enter the inlet portion 17 of the guide hole 9, so that the provisionally-retained condition can be obtained easily and positively. The slanting guide surface 20 on the slanting portion 18 also serves as a relief portion for a curved portion (not shown) formed at the proximal end of the retaining projection 8.

Even if one of the second slanting surface of the retaining projection 8 and the slanting guide surface of the slider is provided, a similar sliding contact effect as described above can be obtained. The retaining projection 8 can be notched in a slanting manner so as to conform to the shape of that portion of the slanting portion 18 disposed at the front end portion of the relief hole 11.

The provisionally-retaining arm 7 of an elastic nature is formed by forming a generally U-shaped notch 23 in one wall (upper wall) 22 of the hood portion 6 (which is larger in size than a terminal receiving portion 21) of the female connector housing 2. The provisionally-retaining arm 7 extends in the connector fitting direction, and is disposed perpendicularly to the direction of insertion of the slider 4. The retaining projection 8 is formed on the inner surface of the provisionally-retaining arm 7 at the distal end thereof, and this retaining projection 8 projects into a slider insertion space 24 in the hood portion 6.

As shown in FIG. 1, guide grooves 26 of a rectangular shape for respectively receiving the follower projections 10 on the male connector housing 5 (FIG. 2) are formed in a front edge portion (inwardly-directed flange) 25 of the hood portion 6, and one of the guide grooves 26 is disposed in opposed relation to the front end of the provisionally-retaining arm 7. A pair of upper and lower slider insertion holes (or slits) 28 are formed through each of opposite side walls 27 of the hood portion 6.

An auxiliary retaining arm 29 of an elastic nature for the female connector housing 2 is formed on that side of the slider 4 remote from the inlet portions 17 of the guide holes 9, and extends in the direction of the length of the slider. The auxiliary retaining arm 29 serves to completely retain the slider 4, but can provisionally retain the slider 4 simultaneously with the provisionally-retaining operation by the provisionally-retaining arm 7.

As shown in FIG. 2, the follower projections 10 on the male connector housing 5 have a short cylindrical shape. The pair of follower projections 10 are formed on a front side portion of each of upper and lower walls 30 of the male connector housing, and the four follower projections 10 correspond respectively to the four guide grooves 26 in the female connector housing 2. The follower projection 10 is disposed in opposed relation to the first slanting surface 8*a* of the retaining projection 8, and the follower projection 10 and the retaining projection 8 are always disposed on a straight line in the connector fitting direction regardless of the depth of fitting of the male connector housing 5 in the female connector housing 2.

In the condition shown in FIG. 2, the retaining projection 8 of the provisionally-retaining arm 7 is engaged in the inlet portion 17 of the guide hole 9 in the slider 4, and the slider 4 is provisionally retained in a completely-locked condition. Therefore, even when a pushing force is applied to the slider 4 upon interference with an external object, the slider 4 will not be pushed or inserted, and therefore a vain operation of the slider 4 (that is, the slider 4 is inserted in vain although the two connector housings 2 and 5 are not yet to be fitted together) is positively prevented. And besides, the provisionally-retaining arm 7 extends perpendicularly to the direction of insertion of the slider, and therefore extends in the connector fitting direction, and the one side surface 8*b* of the retaining projection 8 is pressed by the side surface 17*a* of the inlet portion 17 of the guide hole 9 in the direction of the width of the provisionally-retaining arm 7, and therefore in the provisionally-retained condition, the provisionally-retaining arm 7 will not be buckled, and the retaining force will not become inadequate in contrast with the conventional construction.

In the condition shown in FIG. 2, the slider 4 is much projected outwardly from the female connector housing. In FIG. 2, the inlet portion 17 of the front guide hole 9 (FIG. 1) in the slider 4 is disposed in opposed relation to the right follower projection 10. The male connector housing 5 is not yet fitted in the female connector housing 2.

Female terminals (not shown), each connected to a wire, are received in the male connector housing 5, and male terminals (not shown), each connected to a wire, are received in the female connector housing 2. Tab-like or pin-like electrical contact portions of the male terminals project into the connector fitting chamber 3 (FIG. 1) in the hood portion 6. The female connector housing 2 and the associated terminals jointly form the female connector while the male connector housing 5 and the associated terminals jointly form the male connector.

Figure 3:
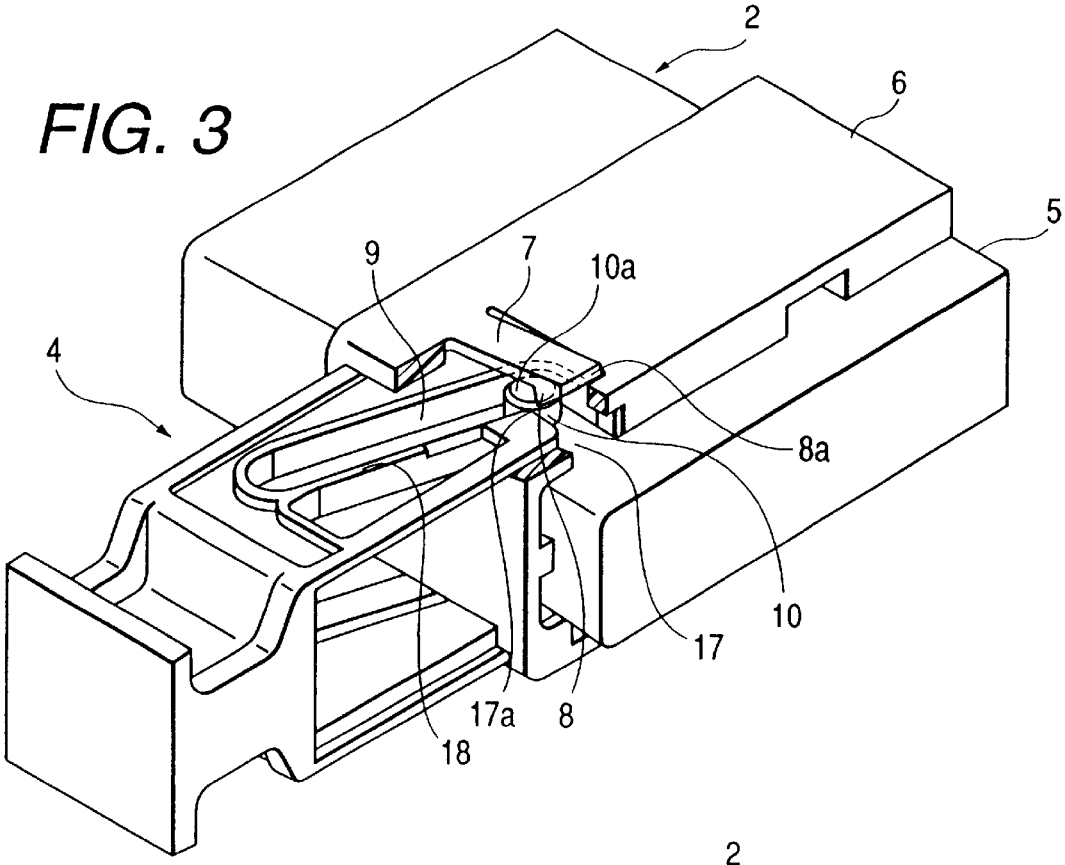
FIG. 3 is a perspective view of the connector, showing an initially-fitted condition of a male connector housing.

Simultaneously when the male connector housing 5 begins to be fitted into the hood portion 6 of the female connector housing 2, the follower projection 10 is pressed against the first slanting surface 8*a* of the retaining projection 8 to elastically deform the provisionally-retaining arm 7 outwardly, as shown in FIG. 3. As a result, the engagement of the retaining projection 8 in the inlet portion 17 of the guide hole 9 is canceled, and therefore the provisionally-retained condition of the slider 4 is canceled, so that the slider 4 can be pushed or inserted. The distal end of the retaining projection 8 is pressed against a circular distal end surface 10*a* of the follower projection 10. Before the distal end of the retaining projection 8 is disengaged from the distal end surface 10*a* of the follower projection 10, the follower projection 10 is pressed against the slanting portion 18 of the guide hole 9, and the slider 4 moves in the pushing direction.

Figure 4:
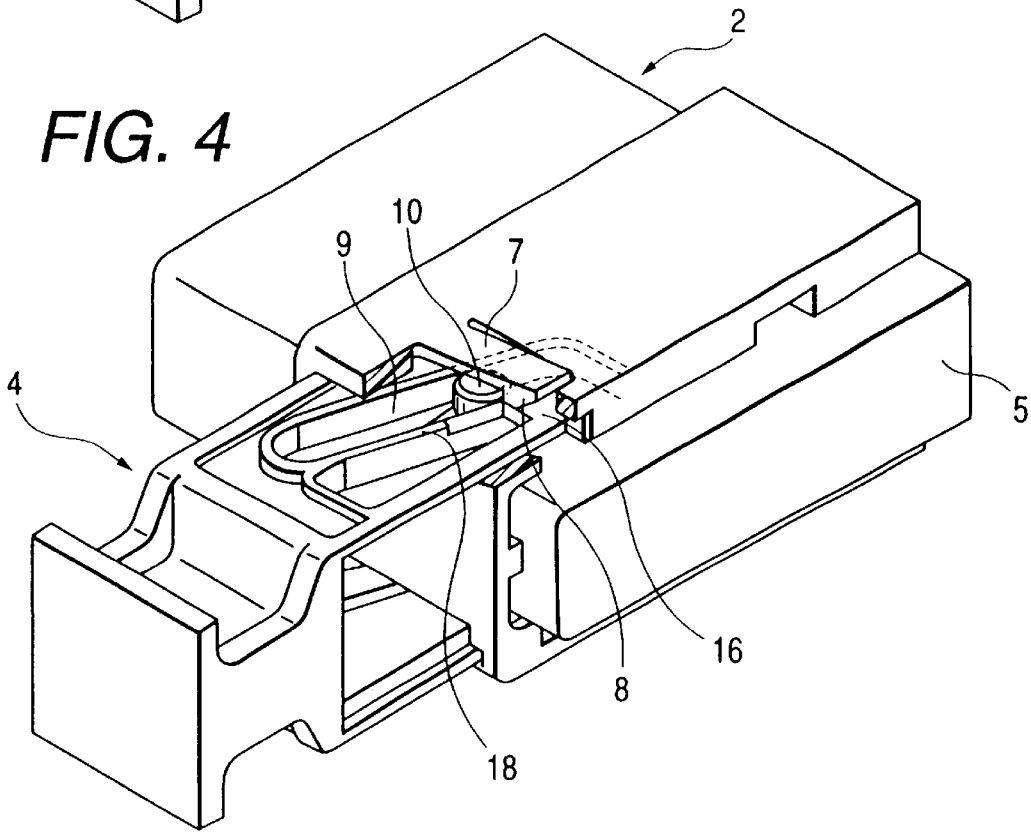
FIG. 4 is a perspective view of the connector, showing a condition in which the provisionally-retained condition of the slider is canceled.

Then, when the slider 4 is pushed in the longitudinal direction as shown in FIG. 4, the retaining projection 8 is brought into sliding contact with the landing portion 16 of the base plate portion 12 of the slider 4, with the provisionally-retaining arm 7 kept elastically deformed outwardly (upwardly). The follower projection 10 is guided in the connector fitting direction while kept in sliding contact with the slanting portion 18 of the guide hole 9. Therefore, the male connector housing 5 is fitted into the female connector housing 2.

The provisionally-retained condition of the slider 4 is canceled by the follower projection 10 on the male connector housing 5, and therefore there is no need to provide any special cancellation member as required for canceling a provisionally-retained condition of the conventional slider, and there is achieved the construction which is simple, compact, lightweight and less costly.

Figure 5:
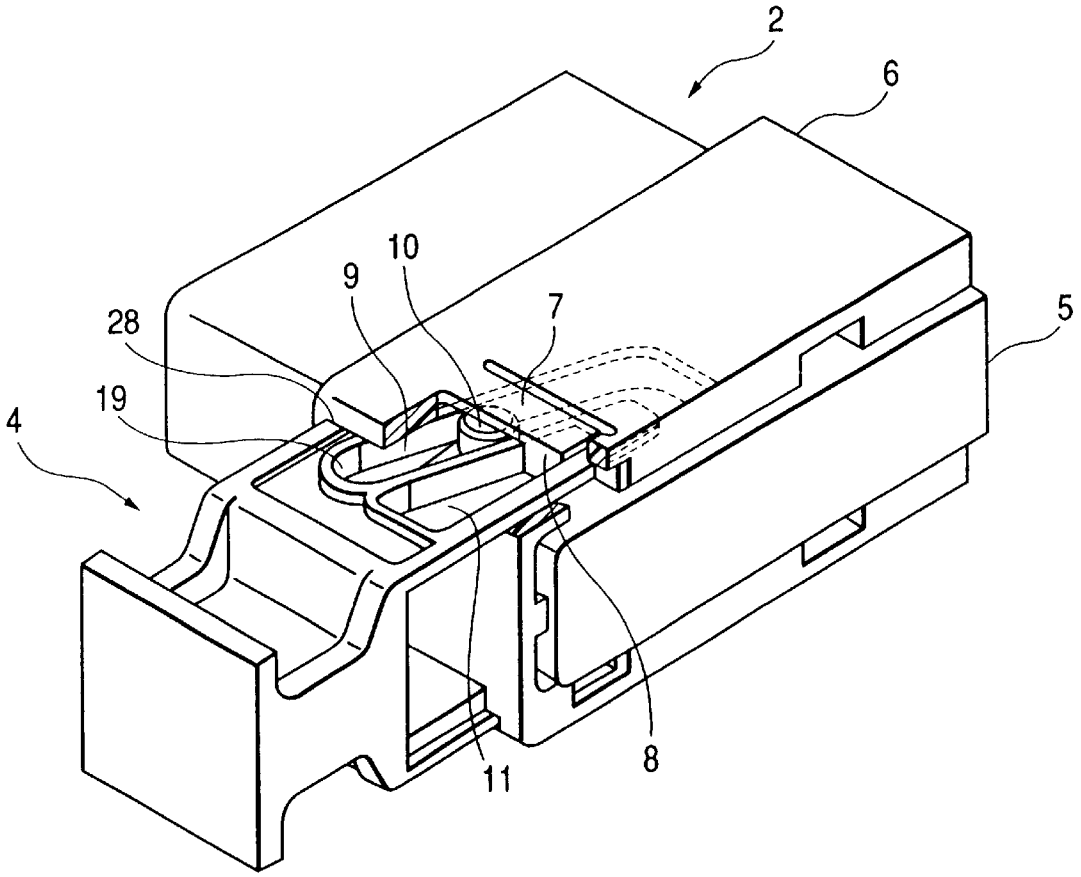
FIG. 5 is a perspective view of the connector, showing a condition in which a provisionally-retaining arm is restored during a connector fitting operation.

As shown in FIG. 5, the retaining projection 8 intrudes into the relief hole 11, and the elastic deformation of the provisionally-retaining arm 7 is canceled, so that this retaining arm 7 is restored into a straight condition. The connector housings 2 and 5 are fitted together in accordance with the pushing (inserting) of the slider 4. When the two connector housings 2 and 5 are completely fitted together, the retaining projection 8 of the provisionally-retaining arm 7 is disposed at a rear end portion of the relief hole 11 while the follower projection 10 is disposed in the lock portion 19 of the guide hole 9. The follower projection 10 is always disposed inwardly of the provisionally-retaining arm 7, and is protected. When the slider 4 is completely pushed or inserted, the front end portions of the slider 4 project outwardly from the hood portion 6 through the respective slider insertion holes 28 (FIG. 1) in the hood portion 6.

The distance between the pair of front and rear guide holes 9, as well as the distance between the pair of follower projections 10, can be reduced, and with this construction, the slider 4 can be fully received within the hood portion 6 such that the front end portions of the slider do not project outwardly from the hood portion 6. For disconnecting the two connector housings 2 and 5 from each other, the slider 4 is pulled in the withdrawing direction, and by doing so, the two connector housings 2 and 5 are smoothly disengaged from each other in the sequence from FIGS. 5 to 2.

FIGS. 6 to 9 sequentially show a pushing (inserting) operation of a slider 4, as well a fitting operation of two connector housings 2 and 5, in a low-insertion force connector 1 analogous to the above-mentioned low-insertion force connector 1. This embodiment differs mainly in dimensions of various portions from the preceding embodiment, and the basic construction of this embodiment is the same as that of the preceding embodiment, and therefore detailed description thereof will be omitted while using the same reference numerals as used in the preceding embodiment.

Figure 6:
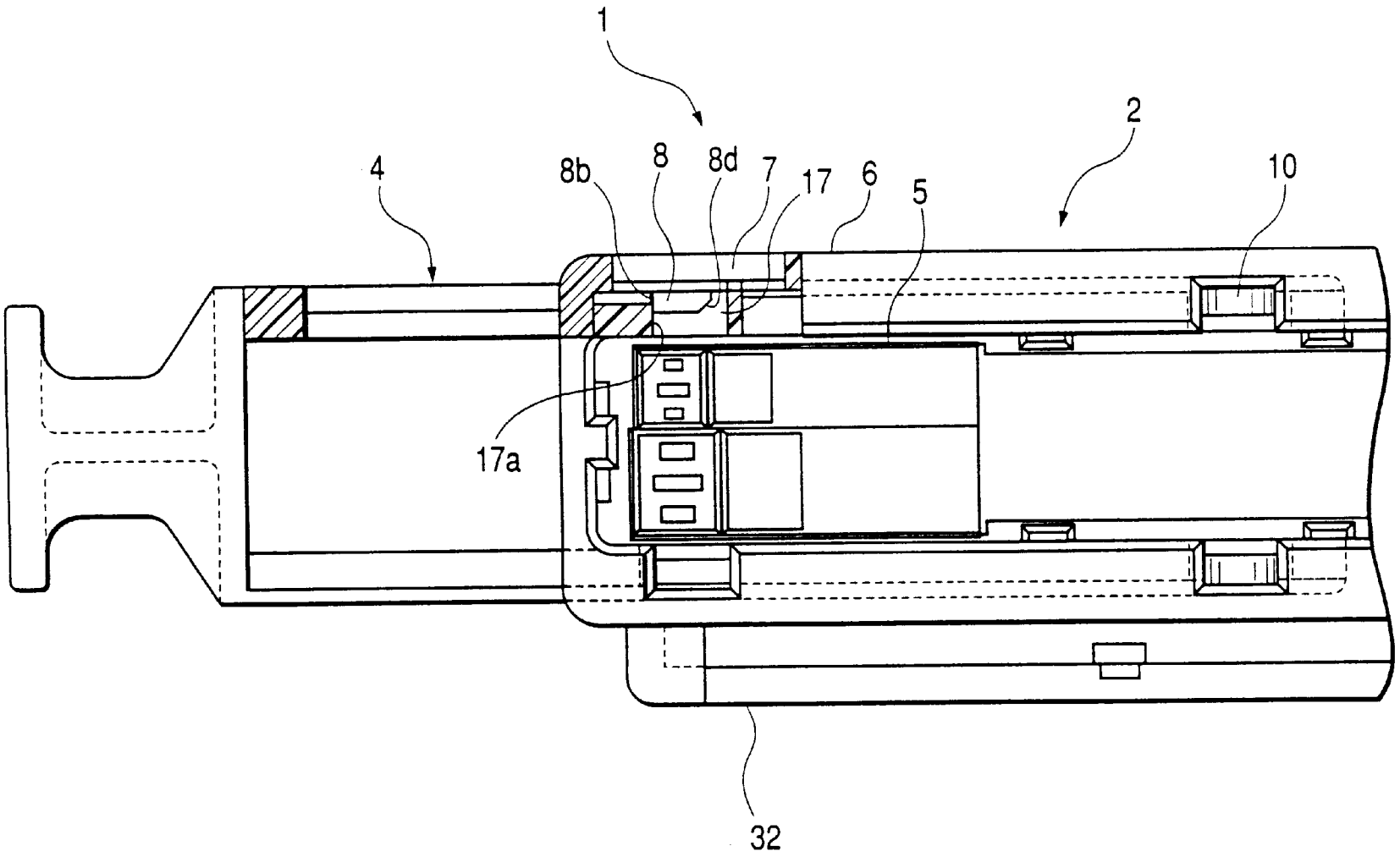
FIG. 6 is a front-elevational view of a similar embodiment of the present invention, showing a provisionally-retained condition of a slider.
Figure 7:
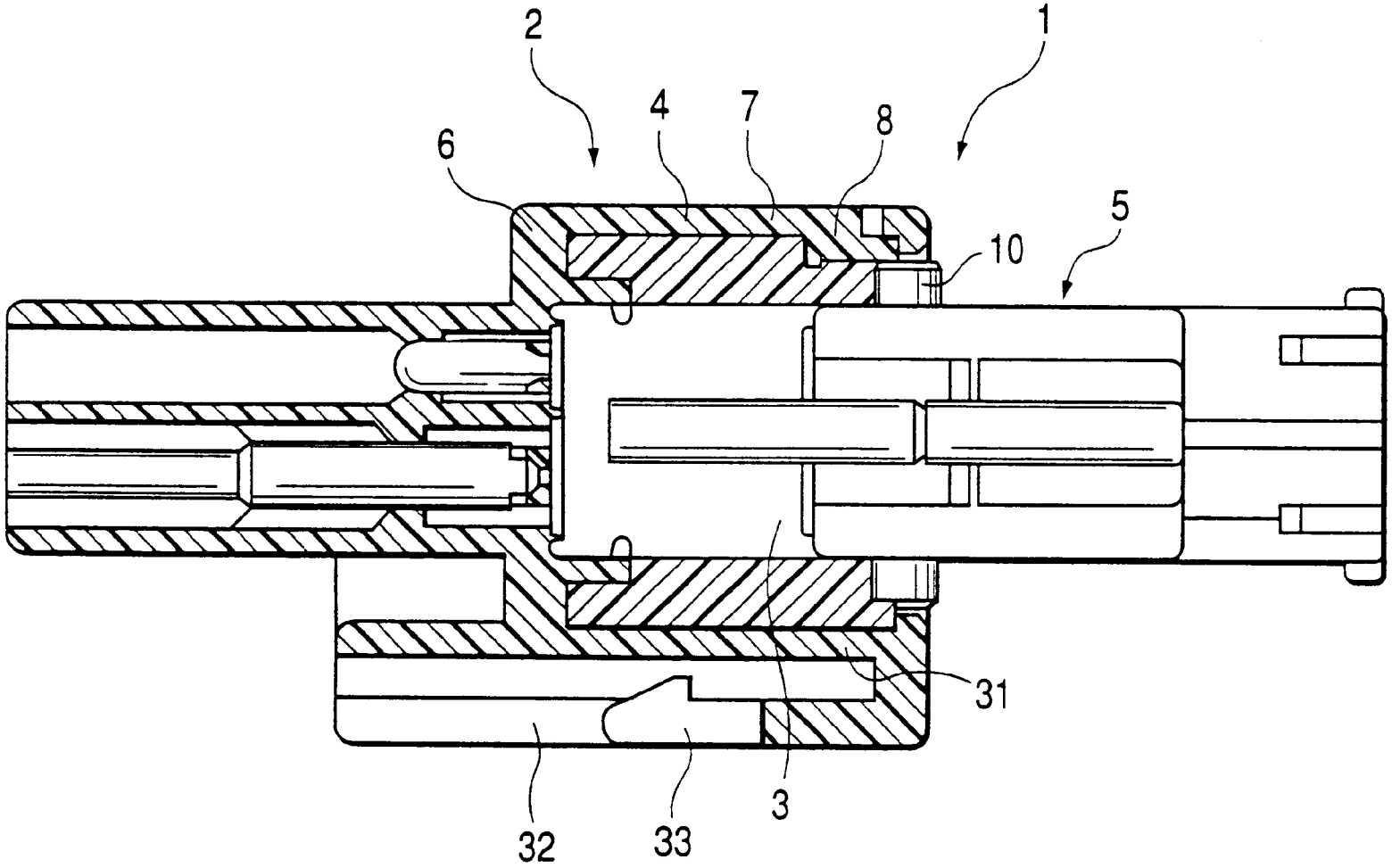
FIG. 7 is a vertical cross-sectional view in the provisionally-retained condition of the slider.

In a provisionally-retained condition of the slider 4, a provisionally-retaining arm 7 is disposed flush with an upper surface of a hood portion 6 as shown in FIGS. 6 and 7. A retaining projection 8 is formed on an inner surface of the provisionally-retaining arm 7. As shown in FIG. 6, the retaining projection 8 has a vertical retaining surface 8*b* (defining one side surface thereof) for abutting engagement with one side surface 17*a* of an inlet portion 17 of a guide hole 9 (FIG. 1) in the slider 4, and also has a second slanting surface 8*d* (defining the other side surface thereof) for sliding contact with a front end of a relief hole 11 (FIG. 1). In this embodiment, the width of the provisionally-retaining arm 7 is larger than the width of the retaining projection 8 and the width of the inlet portion 17. When drawing the slider 4 from the provisionally-retained position so as to disconnect the two connector housings from each other, the other side surface of the inlet portion 17 is smoothly brought into sliding contact with the second slanting surface 8*d*, and therefore the operation can be effected easily.

In the provisionally-retained condition of the slider 4, a distal end portion of the male connector housing 5 is initially inserted into a connector fitting chamber 3 in the female connector housing 2, and a follower projection 10 slightly intrudes into the inlet portion 17, as shown in FIG. 7. A slide engagement portion 32 and a lock arm 33, which are adapted to be fixedly connected to a bracket (not shown) on a vehicle body, are formed on a lower wall 31 of the female connector housing 2.

Figure 8:
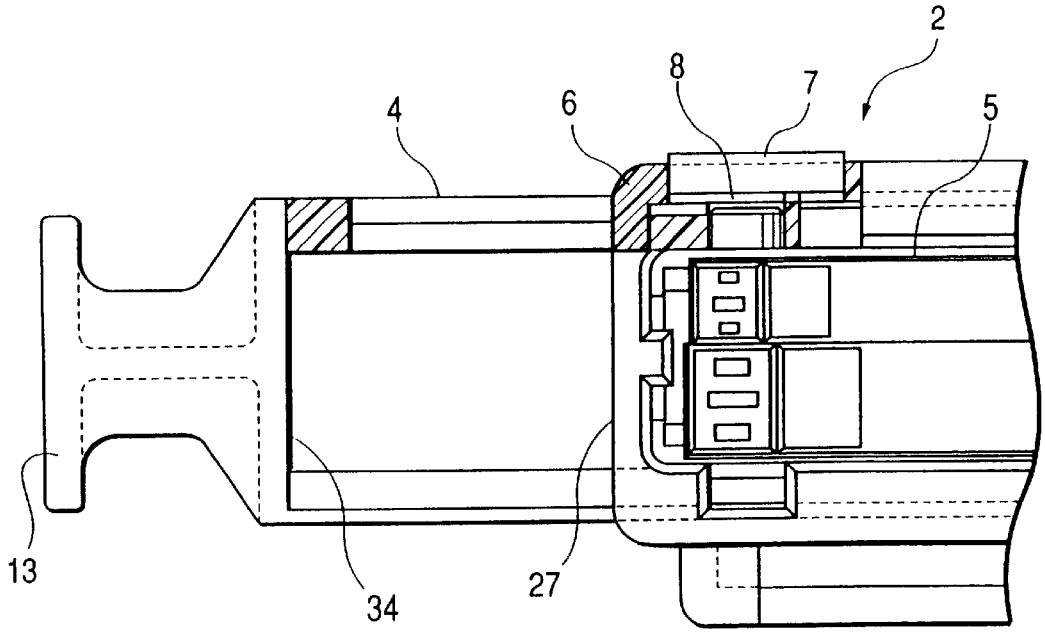
FIG. 8 is a front-elevational view showing the manner of canceling a retained condition of a provisionally-retaining arm.
Figure 9:
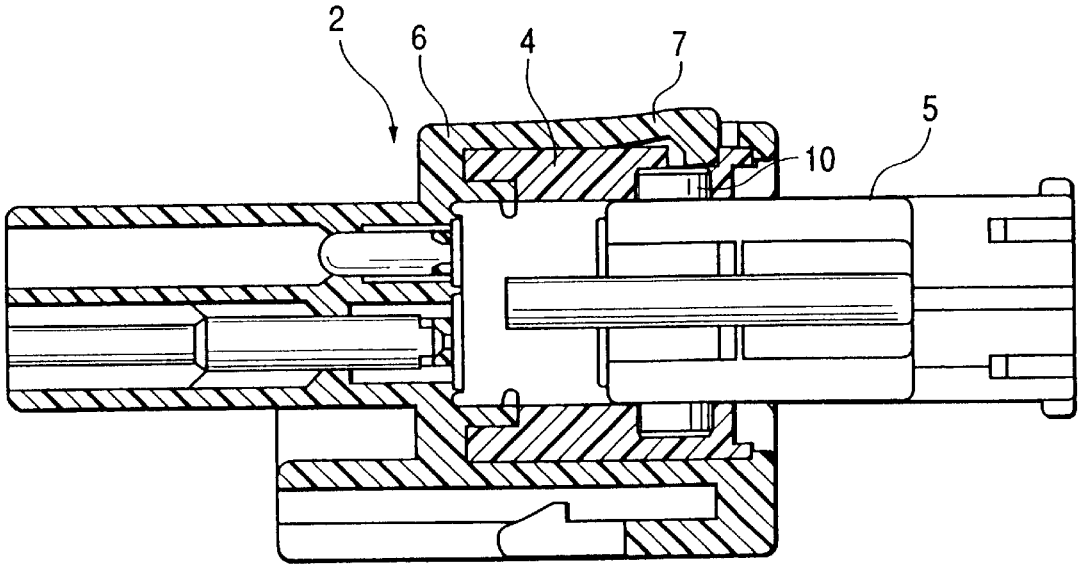
FIG. 9 is a vertical cross-sectional view showing the manner of canceling the retained condition of the provisionally-retaining arm.

During the time when the male connector housing 5 is fitted into the female connector housing 2, the provisionally-retaining arm 7 is raised by the follower projection 10 as shown in FIGS. 8 and 9, so that the provisionally-retained condition of the slider 4 is canceled. The provisionally-retaining arm 7 is elastically deformed to project outwardly from the surface of the hood portion 6.

The provisionally-retaining arm 7 is formed integrally with the hood portion 6, and therefore when provisionally retaining the slider 4 in a connector-non-fitted condition, and when checking the inserting feeling of the slider 4, the provisionally-retaining arm 7 can be easily elastically deformed outwardly by a jig bar or the like (not shown), and therefore the operation is easy. A tapering or slanting portion can be formed at the front end of the slider 4 so as to raise the retaining projection 8, and with this construction the insertion of the slider 4 can be easily effected without the need for elastically deforming the provisionally-retaining arm 7.

In the condition of FIG. 8, when the slider 4 is pushed or inserted, the two connectors are fitted together with a low inserting force. Terminals, each connected to a wire, are received in the female connector housing 2, and terminals, each connected to a wire, are received in the male connector housing 5. A force, required for fitting the male and female terminals together, is reduced by the operation of the slider 4. The provisionally-retaining arm 7 is restored to be disposed flush with the surface of the hood portion 6. When the slider 4 is completely pushed or inserted, an inner surface 34 of an operating portion 13 of the slider is abutted against an outer surface of a side wall 27 of the female connector housing 2. In this embodiment, the slider 4 is completely received within the hood portion 6, and the front end of the slider will not project outwardly from the hood portion 6. Slider insertion holes 28 (FIG. 1) need to be formed only in one side wall 27 of the hood portion 6.

Figures 10A, 10B:
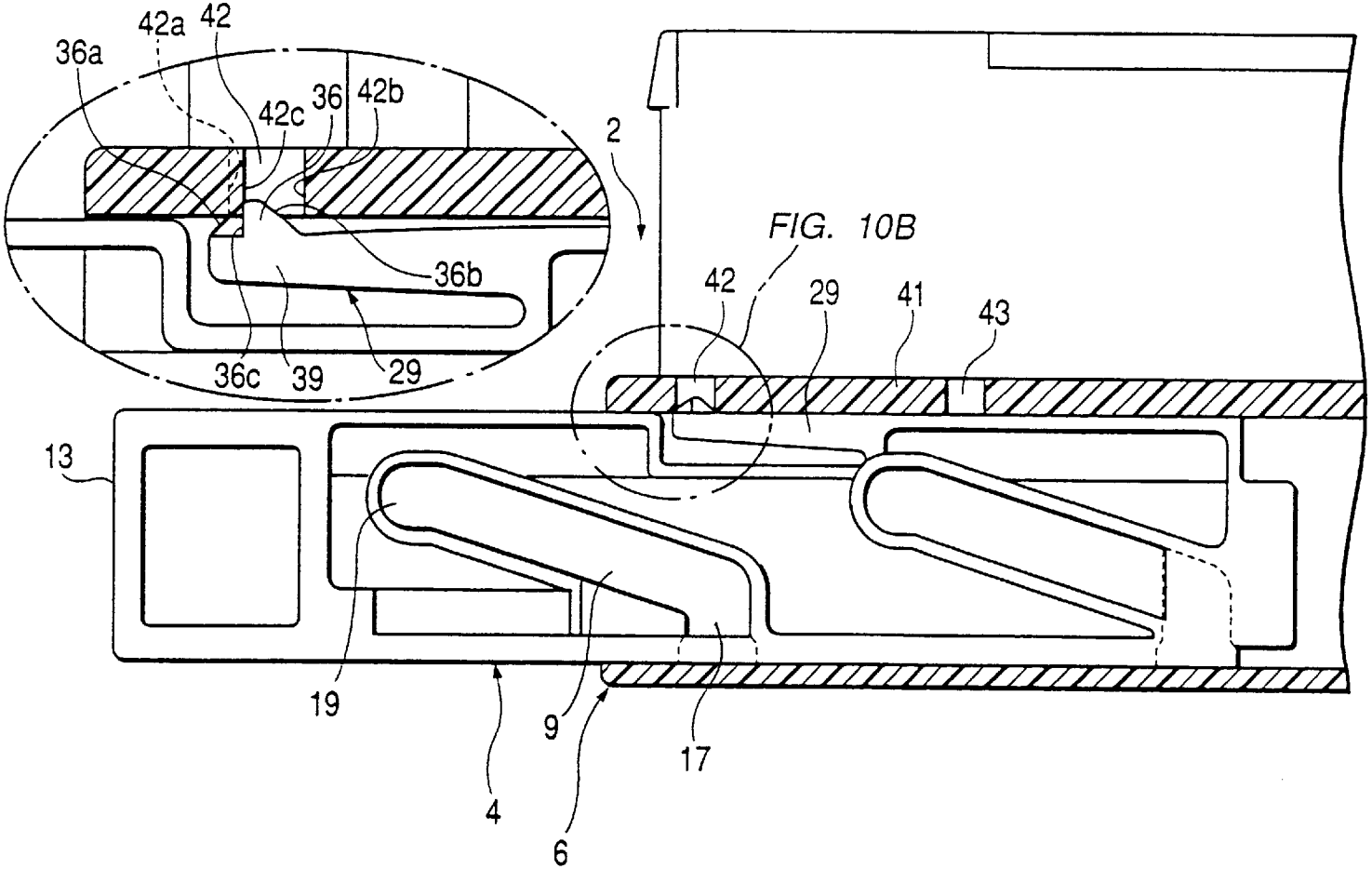
FIG. 10 is a plan view of a similar embodiment of the present invention, showing the retainment of a slider by auxiliary retaining means.
Figure 11:
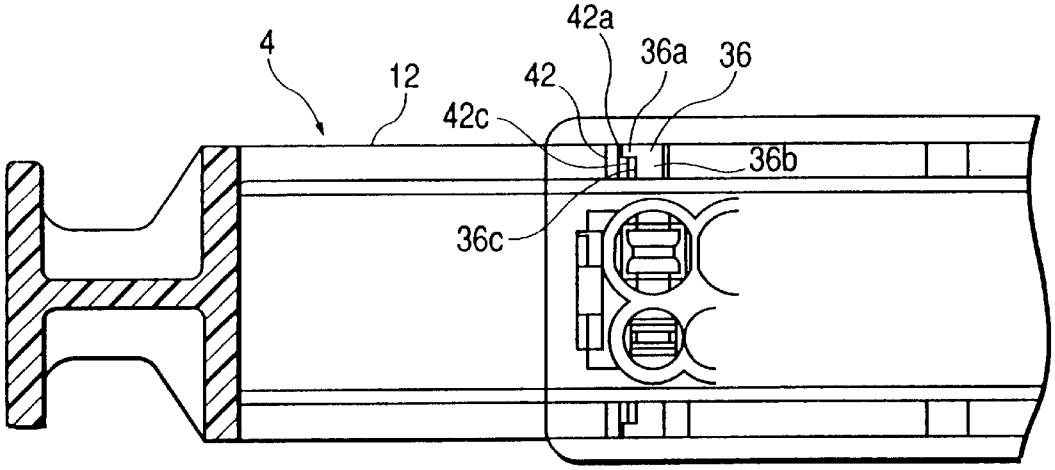
FIG. 11 is a front-elevational view showing the retainment of the slider by the auxiliary retaining means.
Figure 12:
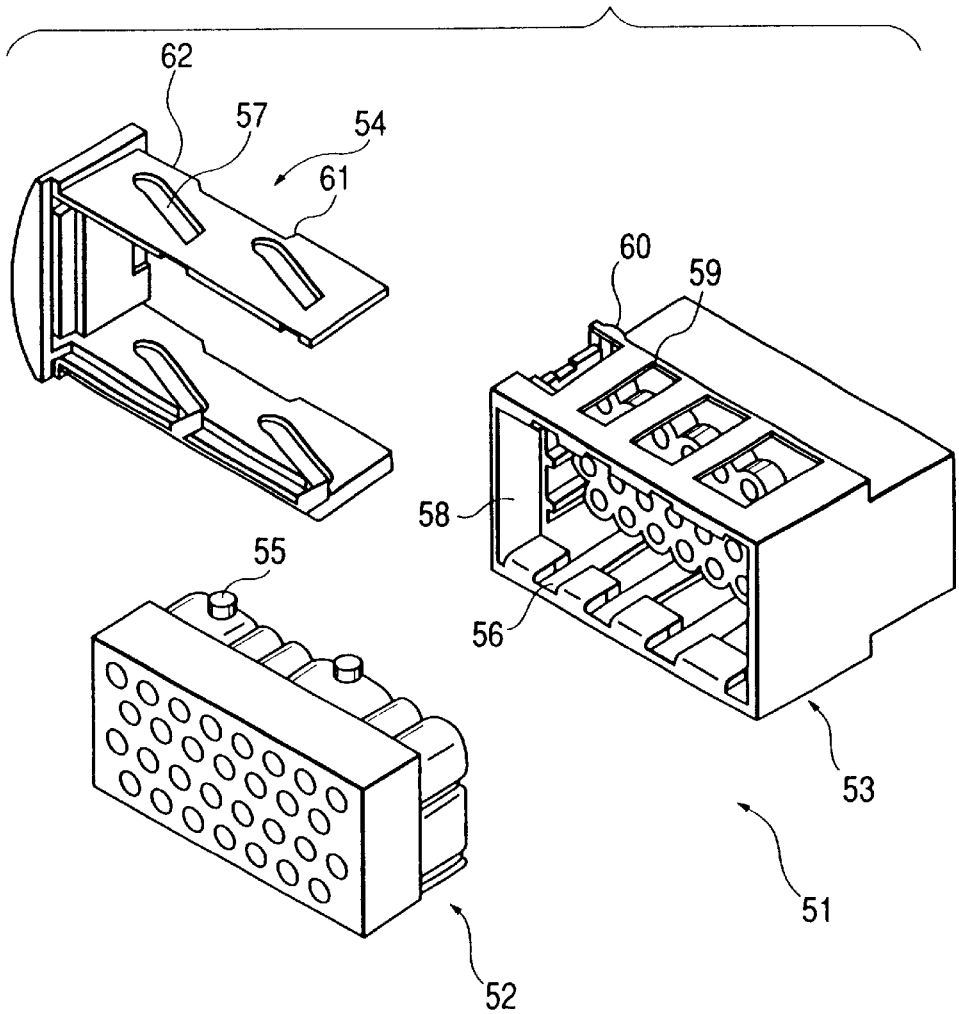
FIG. 12 PRIOR ART
FIG. 12 is an exploded, perspective view of one conventional example.
Figure 13B:
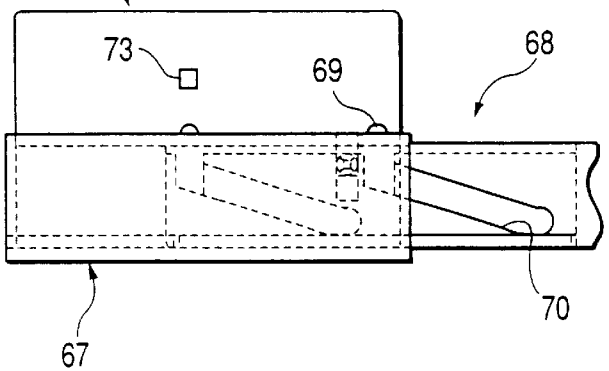
FIG. 13B PRIOR ART
FIGS. 13A and 13B are a vertical cross-sectional view and a plan view of another conventional example.
Figure 13A:
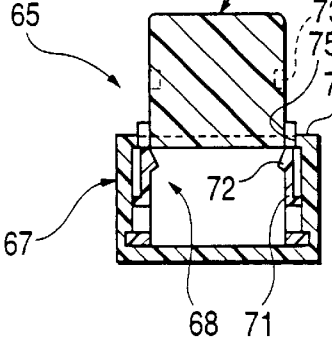
FIG. 13A PRIOR ART
Figure 14B:
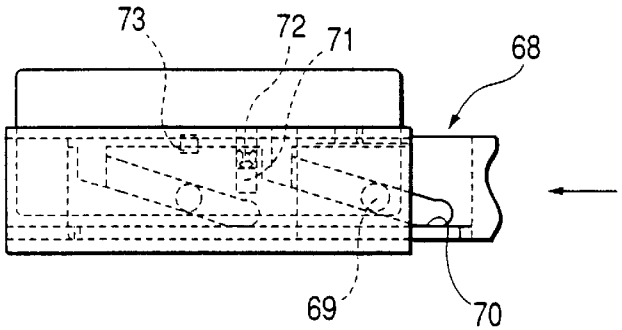
FIG. 14B PRIOR ART
FIGS. 14A and 14B are a vertical cross-sectional view and a plan view, showing a connector-fitting process.
Figure 14A:
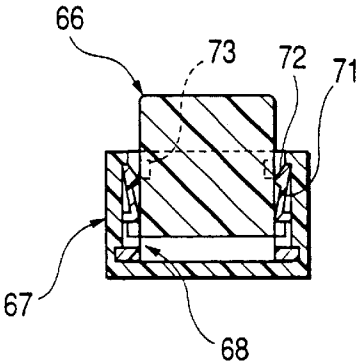
FIG. 14A PRIOR ART

FIGS. 10 and 11 show the operation of the auxiliary retaining arm 29 (FIG. 1) of the slider 4 in the above low-insertion force connector 1.

As shown in FIG. 10, the auxiliary retaining arm 29 is provided intermediate the opposite ends of the slider 4, and is formed on that side of the slider 4 remote from the inlet portions 17 of the guide holes 9, and extends toward the operating portion 13 of the slider 4 in the slider releasing direction. An outwardly-directed, retaining projection 36 is formed at a distal end of the auxiliary retaining arm 29.

A pair of front and rear slanting surfaces 36*a* and 36*b* are formed on the retaining projection 36, and the front slanting surface 36*a* (at the distal end of the retaining projection 36) is notched widthwise to provide a retaining surface 36*c* which is vertical and perpendicular relative to an arm body 39. The front slanting surface 36*a* and the retaining surface 36*c* are juxtaposed and stepped relative to each other in the direction of the width of the auxiliary retaining arm 29. The retaining surface 36*c* is larger in width than the slanting surface 36*a*.

A provisionally-retaining hole 42 of a generally rectangular shape and a completely-retaining hole 43 of a rectangular shape are formed in a bottom wall 41 of the hood portion 6 of the female connector housing 2, and the two holes 42 and 43 are disposed on a straight line, and are spaced from each other in a slider inserting direction. The retaining projection 36 is engageable in the retaining holes 42 and 43.

As shown in FIG. 11, a narrow surface 42*a* for the slanting surface 36*a* of the retaining projection 36 and a wide abutment surface 42*c* for the retaining surface 36*c* are formed on an inner surface of the provisionally-retaining hole 42, and the two surfaces 42*a* and 42*c* are stepped relative to each other in a widthwise direction. The wide abutment surface 42*c* is disposed perpendicular to the slider releasing direction, and also is formed in the bottom wall 41 in the direction of the thickness thereof (that is, perpendicularly to the bottom wall 41). In this embodiment, the auxiliary retaining arm 29 is formed on each of a pair of base plate portions 12 of the slider 4.

In the provisionally-retained condition (FIG. 10) of the slider, when an external pulling force is applied to the slider 4, the vertical retaining surface 36*c* of the auxiliary retaining arm 29 abuts against the vertical abutment surface 42*c* of the hole 42, thereby providing a strong retaining force. Therefore, accidental withdrawal of the slider 4 is prevented. When the slider 4 is intentionally pulled a little harder, the narrow slanting surface 36*a* slidingly contacts the edge of the narrow surface 42*a* of the hole 42, and the retaining projection 36 is smoothly disengaged from the hole 42, so that the provisionally-retained condition of the slider 4 is canceled.

A vertical abutment surface for the vertical retaining surface 36*c* of the retaining projection 36 is not particularly provided at the completely-retaining hole 43. In the completely-retained condition of the slider 4, the slider 4 is kept fully inserted, and therefore the slider 4 is less liable to interfere with an external object, and besides each follower projection 10 on the male connector housing 5 (FIG. 7) is engaged in the horizontal lock portion 19 of the associated guide hole 9, and therefore the slider 4 will not be easily withdrawn.

In the condition of FIG. 10, the slider 4 is pushed or inserted, and simultaneously when the two connector housings 2 and 5 are completely fitted together, the retaining projection 36 of the auxiliary retaining arm 29 is engaged in the completely-retaining hole 43. For canceling the completely-retained condition, the slider 4 is pulled, the slanting surface 36*a* of the retaining projection 36 slidingly contacts the edge of the hole 43, so that this operation can be effected smoothly. When the slider 4 is pushed or inserted, the slanting surface 36*b* of the retaining projection 36 slidingly contacts an edge of the other side surface 42*b* of the hole 42, so that this operation can be effected smoothly. The provisionally-retaining arm 7 (FIG. 6) prevents the provisionally-retained condition of the slider 4 from being accidentally canceled.

As described above, in the present invention, the retaining projection of the provisionally-retaining arm is engaged in the inlet portion of the guide hole in the slider, thereby provisionally retaining the slider. In this condition, the vertical one side surface of the retaining projection abuts against the vertical one side surface of the inlet portion, thereby providing a high retaining force. Therefore, accidental insertion of the slider, for example, during the transport of the connector is positively prevented, and therefore extra time and labor will not be required for pulling the slider.

In the present invention, the provisionally-retaining arm is elastically deformed in the retained condition-canceling direction by the follower projection on the other connector housing, and therefore there is not required any special tool for canceling the provisionally-retained condition, so that the construction is simplified, and is less costly. In the present invention, the retaining projection of the provisionally-retaining arm, elastically deformed by the follower projection, is brought into sliding contact with the landing portion in accordance with the insertion of the slider, and then becomes received in the relief portion, so that the provisionally-retained arm is restored into the original condition. Thus, the cancellation of the retained condition of the provisionally-retaining arm, as well as the restoration of this arm, can be effected smoothly and positively, and after the provisionally-retained condition is cancelled, the retaining projection is not held in resilient contact with any portion of the slider, and therefore the slider inserting operation can be smoothly effected with a small force. In the present invention, when drawing the slider from the completely-inserted condition (that is, in the connector fitted condition) so as to disconnect the two connectors from each other, the other side surface of the retaining projection of the provisionally-retaining arm is smoothly brought into sliding contact with the end edge portion of the relief portion of the slider because of the provision of the slanting surfaces, and therefore the slider drawing operation, that is, the connector disengaging operation, can be smoothly effected with a small force.

In the present invention, the retaining projection of the auxiliary retaining arm is engaged in the provisionally-retaining hole in the one connector housing, and therefore the force to provisionally retain the slider is further increased. The retaining projection of the auxiliary retaining arm is engaged in the completely-retaining hole, and therefore the slider is completely retained in the fully-inserted condition (that is, in the connector fitted condition) against withdrawal. In the present invention, the vertical retaining surface, which is directed in the slider releasing direction, and is formed on the retaining projection of the auxiliary retaining arm, abuts against the vertical abutment surface formed on the inner surface of the provisionally-retaining hole, and therefore accidental withdrawal of the slider from the provisionally-retained condition, for example, during the transport of the connector, is positively prevented, and the slider is prevented from being lost.

What is claimed is:

1. A low-insertion force connector, comprising:

a first connector housing;

a second connector housing fittable to the first connector housing;

a slider insertable into the first connector housing in a direction perpendicular to a connector fitting direction, the slider having at least one slanting guide hole having an inlet portion;

a follower projection insertable in the inlet portion of the guide hole, the follower projection being formed on the second connector housing; and a provisionally-retaining arm formed on the first connector housing to extend in the connector fitting direction, the provisionally-retaining arm having a retaining projection, the retaining projection having a vertical side surface which abuts against a vertical side surface of the inlet portion of the guide hole so as to provisionally retain the slider.

2. A low-insertion force connector according to claim 1, wherein the vertical side surface of the retaining projection and the vertical side surface of the inlet portion of the guide hole extend in a direction substantially perpendicular to a slider inserting direction into the first connector housing.

3. A low-insertion force connector according to claim 1, further comprising an auxiliary retaining arm having a retaining projection, the auxiliary retaining arm being formed on the slider, and wherein a provisionally-retaining hole and a completely-retaining hole for the retaining projection of the auxiliary retaining arm, are formed in the first connector housing.

4. A low-insertion force connector according to claim 3, wherein a vertical retaining surface and a slanting surface, which are directed in the slider releasing direction, are formed on the retaining projection of the auxiliary retaining arm, and a vertical abutment surface contacting the retaining surface is formed on an inner surface of the provisionally-retaining hole.

5. A low-insertion force connector according to claim 1, wherein when the first and second connector housings are about to be fitted together, the retaining projection is located in opposed relation to the follower projection.

6. A low-insertion force connector according to claim 5, further comprising an auxiliary retaining arm having a retaining projection, the auxiliary retaining arm being formed on the slider, and wherein a provisionally-retaining hole and a completely-retaining hole for the retaining projection of the auxiliary retaining arm, are formed in the first connector housing.

7. A low-insertion force connector according to claim 6, wherein a vertical retaining surface and a slanting surface, which are directed in the slider releasing direction, are formed on the retaining projection of the auxiliary retaining arm, and a vertical abutment surface contacting the retaining surface is formed on an inner surface of the provisionally-retaining hole.

8. A low-insertion force connector according to claim 5, further comprising a landing portion and a relief portion for the retaining projection provided at the slider in adjacent relation to the inlet portion, and arranged in a slider releasing direction in an order mentioned above.

9. A low-insertion force connector according to claim 8, further comprising an auxiliary retaining arm having a retaining projection, the auxiliary retaining arm being formed on the slider, and wherein a provisionally-retaining hole and a completely-retaining hole for the retaining projection of the auxiliary retaining arm, are formed in the first connector housing.

10. A low-insertion force connector according to claim 9, wherein a vertical retaining surface and a slanting surface, which are directed in the slider releasing direction, are formed on the retaining projection of the auxiliary retaining arm, and a vertical abutment surface contacting the retaining surface is formed on an inner surface of the provisionally-retaining hole.

11. A low-insertion force connector according to claim 8, wherein at least one of the other side surface of the retaining projection relative to the vertical side surface and an end edge portion of the relief portion is formed in a slanting manner, and wherein when the retaining projection is received in the relief portion, the other side surface of the retaining projection contacts the end edge portion of the relief portion.

12. A low-insertion force connector according to claim 11, further comprising an auxiliary retaining arm having a retaining projection, the auxiliary retaining arm being formed on the slider, and wherein a provisionally-retaining hole and a completely-retaining hole for the retaining projection of the auxiliary retaining arm, are formed in the first connector housing.

13. A low-insertion force connector according to claim 12, wherein a vertical retaining surface and a slanting surface, which are directed in the slider releasing direction, are formed on the retaining projection of the auxiliary retaining arm, and a vertical abutment surface contacting the retaining surface is formed on an inner surface of the provisionally-retaining hole.

* * * * *